US009653783B2

(12) United States Patent
Nickel et al.

(10) Patent No.: US 9,653,783 B2
(45) **Date of Patent: *May 16, 2017**

(54) MULTIBAND ANTENNAS FORMED FROM BEZEL BANDS WITH GAPS

(71) Applicant: Apple Inc., Cupertino, CA (US)

(72) Inventors: Joshua G. Nickel, San Jose, CA (US); Juan Zavala, Watsonville, CA (US); Yijun Zhou, Sunnyvale, CA (US); Mattia Pascolini, San Francisco, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/830,227

(22) Filed: Aug. 19, 2015

(65) Prior Publication Data

US 2015/0357703 A1 Dec. 10, 2015

Related U.S. Application Data

(63) Continuation of application No. 12/752,966, filed on Apr. 1, 2010.

(51) Int. Cl.
*H01Q 1/38* (2006.01)
*H01Q 1/24* (2006.01)
(Continued)

(52) U.S. Cl.
CPC ..... *H01Q 1/243* (2013.01); *H01Q 1/48* (2013.01); *H01Q 5/364* (2015.01); *H01Q 9/0421* (2013.01); *H01Q 9/42* (2013.01)

(58) Field of Classification Search
CPC ..... H01Q 1/243; H01Q 9/0421; H01Q 9/42; H01Q 5/364
See application file for complete search history.

(56) References Cited

U.S. PATENT DOCUMENTS 2,942,263 A 6/1960 Baldwin
3,394,373 A 7/1968 Makrancy
(Continued)

FOREIGN PATENT DOCUMENTS

CN 1292583 4/2001
CN 1216438 8/2005
(Continued)

OTHER PUBLICATIONS

Antenna Theory: A Review, Balanis, Proc. IEEE vol. 80 No. 1 Jan. 1992.*
U.S. Appl. No. 60/833,587, filed Jan. 5, 2007, Hobson et al.

*Primary Examiner* — Robert Karacsony
*Assistant Examiner* — Amal Patel
(74) *Attorney, Agent, or Firm* — Treyz Law Group, P.C.; G. Victor Treyz; Michael H. Lyons

(57) ABSTRACT

Electronic devices are provided that contain wireless communications circuitry. The wireless communications circuitry may include radio-frequency transceiver circuitry and antenna structures. An inverted-F antenna may have first and second short circuit legs and a feed leg. The first and second short circuit legs and the feed leg may be connected to a folded antenna resonating element arm. The antenna resonating element arm and the first short circuit leg may be formed from portions of a conductive electronic device bezel. The folded antenna resonating element arm may have a bend. The bezel may have a gap that is located at the bend. Part of the folded resonating element arm may be formed from a conductive trace on a dielectric member. A spring may be used in connecting the conductive trace to the electronic device bezel portion of the antenna resonating element arm.

15 Claims, 10 Drawing Sheets

(51) Int. Cl.

| | |
|---|---|
| ***H01Q 9/04*** | (2006.01) |
| ***H01Q 1/48*** | (2006.01) |
| ***H01Q 9/42*** | (2006.01) |
| ***H01Q 5/364*** | (2015.01) |

(56) References Cited

U.S. PATENT DOCUMENTS

| | | | | |
|---|---|---|---|---|
| 4,879,755 | A | 11/1989 | Stolarczyk et al. | |
| 4,894,663 | A | 1/1990 | Urbish | |
| 4,980,694 | A | 12/1990 | Hines | |
| 5,021,010 | A | 6/1991 | Wright | |
| 5,041,838 | A | 8/1991 | Liimatainen | |
| 5,048,118 | A | 9/1991 | Brooks | |
| 5,061,943 | A | 10/1991 | Rammos | |
| 5,105,396 | A | 4/1992 | Ganter et al. | |
| 5,381,387 | A | 1/1995 | Blonder et al. | |
| 5,408,241 | A | 4/1995 | Shattuck | |
| 5,473,252 | A | 12/1995 | Renz et al. | |
| 5,561,437 | A | 10/1996 | Phillips | |
| 5,684,492 | A | 11/1997 | Kagoshima et al. | |
| 5,754,143 | A | 5/1998 | Warnagiris | |
| 5,798,984 | A | 8/1998 | Koch | |
| 5,828,341 | A | 10/1998 | Delamater | |
| 6,011,699 | A | 1/2000 | Murray | |
| 6,097,345 | A | 8/2000 | Walton | |
| 6,147,652 | A | 11/2000 | Sekine | |
| 6,269,054 | B1 | 7/2001 | Truini | |
| 6,282,433 | B1 | 8/2001 | Holshouser | |
| 6,337,662 | B1 | 1/2002 | Cassel | |
| 6,373,439 | B1 * | 4/2002 | Zurcher | H01Q 1/22 343/702 |
| 6,518,929 | B1 | 2/2003 | Gilmore | |
| 6,622,031 | B1 | 9/2003 | McCleary | |
| 6,662,028 | B1 * | 12/2003 | Hayes | H01Q 1/243 343/908 |
| 6,670,923 | B1 | 12/2003 | Kadambi et al. | |
| 6,683,578 | B2 * | 1/2004 | Nishikido | H01Q 1/243 343/700 MS |
| 6,741,214 | B1 | 5/2004 | Kadambi et al. | |
| 6,747,601 | B2 | 6/2004 | Boyle | |
| 6,762,723 | B2 | 7/2004 | Nallo | |
| 6,825,811 | B2 | 11/2004 | Iwai et al. | |
| 6,853,605 | B2 | 2/2005 | Fujisawa et al. | |
| 6,856,294 | B2 | 2/2005 | Kadambi et al. | |
| 6,968,508 | B2 | 11/2005 | Lucaci | |
| 6,980,154 | B2 * | 12/2005 | Vance | H01Q 1/243 343/700 MS |
| 7,027,838 | B2 | 4/2006 | Zhou et al. | |
| 7,035,170 | B2 | 4/2006 | Narayanaswami et al. | |
| 7,116,276 | B2 | 10/2006 | Lee | |
| 7,119,747 | B2 | 10/2006 | Lin et al. | |
| 7,123,208 | B2 | 10/2006 | Baliarda et al. | |
| 7,215,600 | B1 | 5/2007 | DeRosa | |
| 7,595,759 | B2 | 9/2009 | Schlub et al. | |
| 7,612,725 | B2 | 11/2009 | Hill et al. | |
| 7,714,790 | B1 | 5/2010 | Feldstein et al. | |
| 7,768,462 | B2 | 8/2010 | Zhang et al. | |
| 7,768,468 | B2 | 8/2010 | Gustafson et al. | |
| 7,889,139 | B2 | 2/2011 | Hobson et al. | |
| 8,009,110 | B2 | 8/2011 | Teng et al. | |
| 8,269,675 | B2 | 9/2012 | Kough et al. | |
| 8,270,914 | B2 | 9/2012 | Pascolini et al. | |
| 8,665,164 | B2 | 3/2014 | Hill et al. | |
| 2001/0043514 | A1 | 11/2001 | Kita | |
| 2002/0126236 | A1 | 9/2002 | Hiratsuka | |
| 2003/0107518 | A1 | 6/2003 | Li et al. | |
| 2003/0124985 | A1 | 7/2003 | Shin et al. | |
| 2004/0017318 | A1 | 1/2004 | Annabi | |
| 2004/0090377 | A1 | 5/2004 | Dai et al. | |
| 2004/0145521 | A1 | 7/2004 | Hebron et al. | |
| 2004/0227674 | A1 | 11/2004 | Asano et al. | |
| 2004/0257283 | A1 * | 12/2004 | Asano | H01Q 1/243 343/702 |
| 2005/0099344 | A1 | 5/2005 | Okubo et al. | |
| 2005/0270242 | A1 | 12/2005 | Qi et al. | |
| 2006/0001582 | A1 | 1/2006 | Hayashi | |
| 2006/0055606 | A1 | 3/2006 | Boyle | |
| 2006/0097941 | A1 | 5/2006 | Bettner et al. | |
| 2006/0125703 | A1 | 6/2006 | Ma et al. | |
| 2006/0244663 | A1 | 11/2006 | Fleck et al. | |
| 2007/0116947 | A1 | 5/2007 | Hackbarth et al. | |
| 2007/0176843 | A1 | 8/2007 | Qureshi | |
| 2007/0182658 | A1 | 8/2007 | Ozden | |
| 2008/0143613 | A1 | 6/2008 | Iwai et al. | |
| 2008/0150811 | A1 * | 6/2008 | Honda | H01Q 9/40 343/702 |
| 2009/0009007 | A1 | 1/2009 | Kato et al. | |
| 2009/0153407 | A1 | 6/2009 | Zhang | |
| 2009/0231215 | A1 | 9/2009 | Taura | |
| 2009/0256758 | A1 | 10/2009 | Schlub et al. | |
| 2009/0262029 | A1 | 10/2009 | Chiang et al. | |
| 2010/0053002 | A1 | 3/2010 | Wojack et al. | |
| 2010/0073241 | A1 | 3/2010 | Ayala Vazquez et al. | |
| 2010/0123633 | A1 * | 5/2010 | Ozden | H01Q 1/243 343/702 |
| 2010/0289709 | A1 | 11/2010 | Guan | |
| 2010/0321325 | A1 | 12/2010 | Springer et al. | |
| 2011/0006953 | A1 | 1/2011 | Chiang et al. | |
| 2013/0229322 | A1 | 9/2013 | Wang | |

FOREIGN PATENT DOCUMENTS

| | | | |
|---|---|---|---|
| CN | 101207229 | | 6/2008 |
| CN | 202025842 | | 11/2011 |
| EP | 1093098 | | 4/2001 |
| EP | 1324425 | | 6/2002 |
| EP | 1 286 413 | | 2/2003 |
| EP | 1 315 238 | | 5/2003 |
| EP | 1324425 | | 7/2003 |
| EP | 1 401 050 | | 3/2004 |
| EP | 2034558 | | 5/2007 |
| EP | 2034558 | | 3/2009 |
| JP | 58-104504 | A | 6/1983 |
| JP | H04-014305 | A | 1/1992 |
| JP | 09-093029 | A | 4/1997 |
| JP | 11-340867 | | 12/1999 |
| JP | 2999754 | B | 1/2000 |
| JP | 2001185927 | | 7/2001 |
| JP | 2005142785 | | 6/2005 |
| JP | 2008159636 | | 7/2008 |
| JP | 2008-199204 | A | 8/2008 |
| JP | 2009095067 | | 4/2009 |
| JP | 2009-171528 | A | 7/2009 |
| JP | 2009-278376 | A | 11/2009 |
| TW | 310084 | | 7/1997 |
| TW | 200929687 | | 7/2009 |
| WO | 0125023 | | 4/2001 |
| WO | 02/078123 | | 10/2002 |
| WO | 04/001894 | | 12/2003 |
| WO | 2005032130 | | 4/2005 |
| WO | 2005/109567 | | 11/2005 |
| WO | 2006/114771 | | 11/2006 |
| WO | 2007/039668 | | 4/2007 |
| WO | 2007125752 | | 11/2007 |
| WO | 2010025023 | | 3/2010 |

* cited by examiner

MULTIBAND ANTENNAS FORMED FROM BEZEL BANDS WITH GAPS

This application is a continuation of patent application Ser. No. 12/752,966, filed Apr. 1, 2010, which is hereby incorporated by reference herein in its entirety. This application claims the benefit of and claims priority to patent application Ser. No. 12/752,966, filed Apr. 1, 2010.

BACKGROUND

This relates generally to wireless communications circuitry, and more particularly, to electronic devices that have wireless communications circuitry.

Electronic devices such as computers and handheld electronic devices are becoming increasingly popular. Devices such as these are often provided with wireless communications capabilities. For example, electronic devices may use long-range wireless communications circuitry such as cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz. Some devices incorporate wireless circuitry for receiving Global Positioning System (GPS) signals at 1575 MHz.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures.

It would therefore be desirable to be able to provide improved wireless communications circuitry for wireless electronic devices.

SUMMARY

Electronic devices may be provided that include antenna structures. An inverted-F antenna may be configured to operate in first and second communications bands. An electronic device may contain radio-frequency transceiver circuitry that is coupled to the antenna using a transmission line. The transmission line may have a positive conductor and a ground conductor. The antenna may have a positive antenna feed terminal and a ground antenna feed terminal to which the positive and ground conductors of the transmission line are respectively coupled.

The electronic device may have a rectangular periphery. A rectangular display may be mounted on a front face of the electronic device. Conductive sidewall structures may run around the periphery of the electronic device housing and display. The conductive sidewall structures may serve as a bezel for the display.

The bezel may include at least one gap. The gap may be filled with a solid dielectric such as plastic. The antenna may have a main resonating element arm. The resonating element arm may be folded at a bend. A first segment of the resonating element arm may be formed from a portion of the bezel. A second segment of the resonating element arm may be formed from a conductive trace on a dielectric member. A spring in the vicinity of the bend may be used in connecting the first and second segments of the resonating element arm. The bend may be located at the gap in the bezel.

First and second parallel short circuit legs may connect the antenna resonating element arm to a ground. A feed leg may be connected between the antenna resonating element and a first antenna feed terminal. A second antenna feed terminal may be connected to the ground. The first short circuit leg may be formed from a portion of the bezel.

Further features of the invention, its nature and various advantages will be more apparent from the accompanying drawings and the following detailed description of the preferred embodiments.

DETAILED DESCRIPTION

Electronic devices may be provided with wireless communications circuitry. The wireless communications circuitry may be used to support wireless communications in multiple wireless communications bands. The wireless communications circuitry may include one or more antennas.

The antennas can include inverted-F antennas. An inverted-F antenna for an electronic device may include a folded arm. The use of a folded arm may help minimize the size of the antenna. A shorting structure in the inverted-F antenna may enhance the performance of the antenna by allowing the antenna to operate efficiently in multiple communications bands.

Conductive structures for an inverted-F antenna may, if desired, be formed from conductive electronic device structures. The conductive electronic device structures may include conductive housing structures. The housing structures may include a conductive structure that surrounds the periphery of the device. This structure may take the form of a conductive metal band that surrounds all four edges of the device. A display and other components may be mounted to the device within the confines of the metal band. In this respect, the metal band may serve as a bezel and may therefore sometimes be referred to herein as a bezel or conductive bezel structure.

Gap structures may be formed in the bezel. The presence of a gap may, for example, help define the location of a fold in a folded inverted-F antenna resonating element arm.

Any suitable electronic devices may be provided with wireless circuitry that includes inverted-F antenna structures that are based on conductive device structures such as device bezels. As an example, inverted-F antenna structures of this type may be used in electronic devices such as desktop computers, game consoles, routers, laptop computers, etc. With one suitable configuration, bezel-based inverted-F antenna structures are provided in relatively compact electronic devices in which interior space is relatively valuable such as portable electronic devices.

Figure 1:
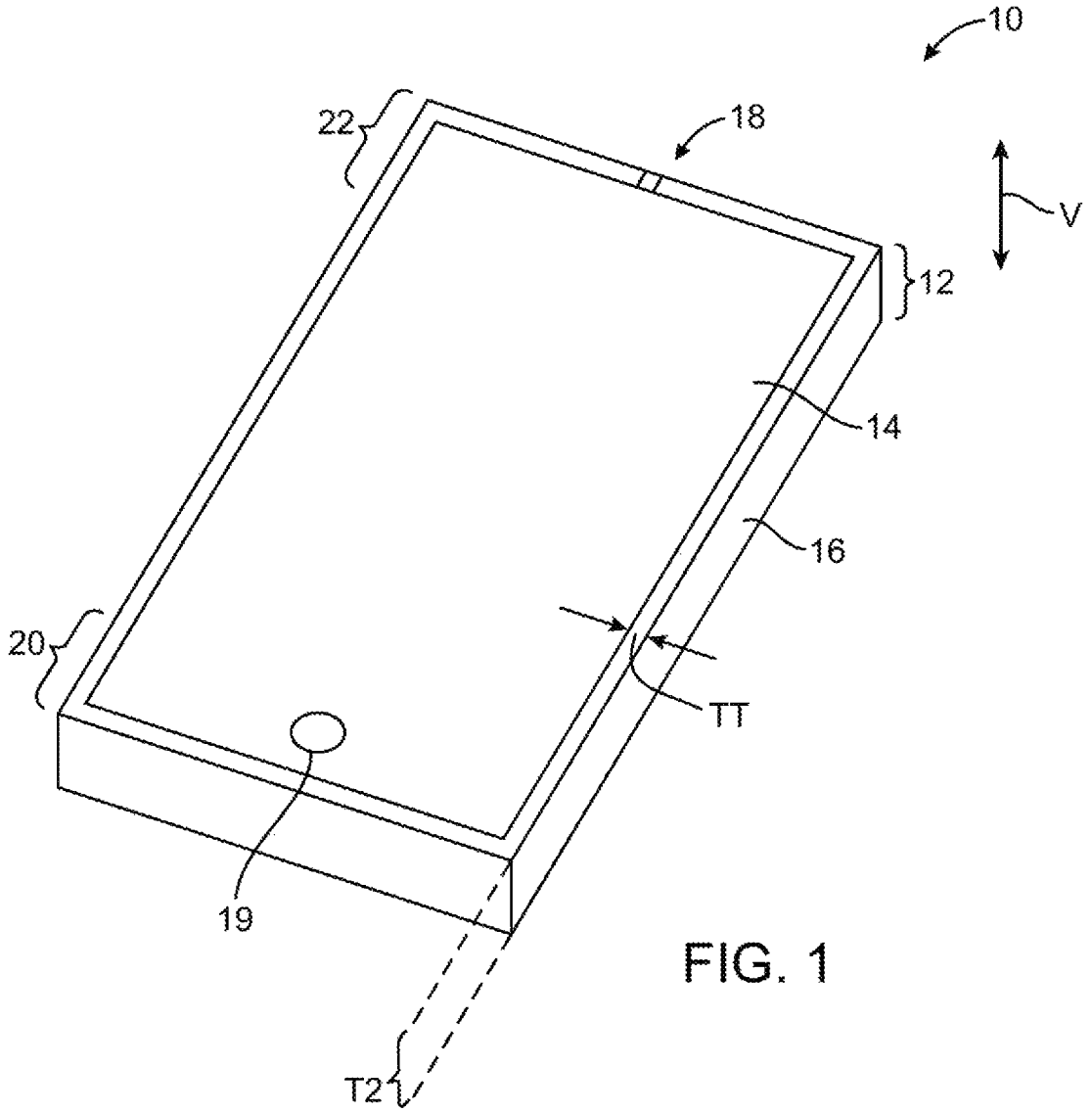
FIG. 1 is a perspective view of an illustrative electronic device with wireless communications circuitry in accordance with an embodiment of the present invention.

An illustrative portable electronic device in accordance with an embodiment of the present invention is shown in FIG. 1. Portable electronic devices such as illustrative portable electronic device 10 of FIG. 1 may be laptop computers or small portable computers such as ultraportable computers, netbook computers, and tablet computers. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices are handheld electronic devices such as cellular telephones.

Space is at a premium in portable electronic devices. Conductive structures are also typically present, which can make efficient antenna operation challenging. For example, conductive housing structures may be present around some or all of the periphery of a portable electronic device housing.

In portable electronic device housing arrangements such as these, it may be particularly advantageous to use an inverted-F antenna in which some of the antenna is formed using conductive housing structures. The use of portable devices such as handheld devices is therefore sometimes described herein as an example, although any suitable electronic device may be provided with inverted-F antenna structures, if desired.

Handheld devices may be, for example, cellular telephones, media players with wireless communications capabilities, handheld computers (also sometimes called personal digital assistants), remote controllers, global positioning system (GPS) devices, and handheld gaming devices. Handheld devices and other portable devices may, if desired, include the functionality of multiple conventional devices. Examples of multi-functional devices include cellular telephones that include media player functionality, gaming devices that include wireless communications capabilities, cellular telephones that include game and email functions, and handheld devices that receive email, support mobile telephone calls, and support web browsing. These are merely illustrative examples. Device 10 of FIG. 1 may be any suitable portable or handheld electronic device.

Device 10 includes housing 12 and includes at least one antenna for handling wireless communications. Housing 12, which is sometimes referred to as a case, may be formed of any suitable materials including, plastic, glass, ceramics, carbon-fiber composites and other composites, metal, other suitable materials, or a combination of these materials. In some situations, parts of housing 12 may be formed from dielectric or other low-conductivity material, so that the operation of conductive antenna elements that are located within housing 12 is not disrupted. In other situations, housing 12 may be formed from metal elements.

Device 10 may, if desired, have a display such as display 14. Display 14 may, for example, be a touch screen that incorporates capacitive touch electrodes. Display 14 may include image pixels formed form light-emitting diodes (LEDs), organic LEDs (OLEDs), plasma cells, electronic ink elements, liquid crystal display (LCD) components, or other suitable image pixel structures. A cover glass member may cover the surface of display 14. Buttons such as button 19 may pass through openings in the cover glass.

Housing 12 may include sidewall structures such as housing sidewall structures 16. Structures 16 may be implemented using conductive materials. For example, structures 16 may be implemented using a conductive ring-shaped member that substantially surrounds the rectangular periphery of display 14. Structures of this type are sometimes said to form a band around the periphery of device 10, so sidewall structures 16 may sometimes be referred to as band structures, a band member, or a band.

Structures 16 may be formed from a metal such as stainless steel, aluminum, or other suitable materials. One, two, or more than two separate structures may be used in forming structures 16. Structures 16 may serve as a bezel that holds display 14 to the front (top) face of device 10. Structures 16 are therefore sometimes referred to herein as bezel structures 16 or bezel 16.

Bezel 16 runs around the rectangular periphery of device 10 and display 14. Bezel 16 may be confined to the upper portions of device 10 (i.e., peripheral regions that lie near the surface of display 14) or may cover the entire vertical height of the sidewalls of device 10 (e.g., as shown in the example of FIG. 1). Other configurations are also possible such as configurations in which bezel 16 or other sidewall structures are partly or fully integrated with the rear wall of housing 12 (e.g., in a unibody-type construction).

Bezel (band) 16 may have a thickness (dimension TT) of about 0.1 mm to 3 mm (as an example). The sidewall portions of bezel 16 may be substantially vertical (parallel to vertical axis V) or may be curved. In the example of FIG. 1, bezel 16 has relatively planar exterior surfaces. Parallel to axis V, bezel 16 may have a dimension T2 of about 1 mm to 2 cm (as an example). The aspect ratio R of bezel 16 (i.e., the ratio R of T2 to TT) is typically more than 1 (i.e., R may be greater than or equal to 1, greater than or equal to 2, greater than or equal to 4, greater than or equal to 10, etc.). The electronic device may have a width that is perpendicular to axis V, a height that is perpendicular to axis V and perpendicular to the width, and a height (T2) parallel to axis V.

It is not necessary for bezel 16 to have a uniform cross-section. For example, the top portion of bezel 16 may, if desired, have an inwardly protruding lip that helps hold display 14 in place. If desired, the bottom portion of bezel 16 may also have an enlarged lip (e.g., in the plane of the rear surface of device 10). In the example of FIG. 1, bezel 16 has substantially straight vertical sidewalls. This is merely illustrative. The interior and exterior surfaces of bezel 16 may be curved or may have any other suitable shapes.

Display 14 includes conductive structures. The conductive structures may include an array of capacitive electrodes, conductive lines for addressing pixel elements, driver circuits, etc. These conductive structures tend to block radio-frequency signals. It may therefore be desirable to form some or all of the rear planar surface of device from a dielectric material such as glass or plastic, so that antenna signals are not blocked. If desired, the rear of housing 12 may be formed from metal and other portions of device 10 may be formed from dielectric. For example, antenna structures may be located under dielectric portions of display 14 such as portions of display 14 that are covered with cover glass and that do not contain conductive components.

Portions of bezel 16 may be provided with gap structures. For example, bezel 16 may be provided with one or more gaps such as gap 18, as shown in FIG. 1. Gap 18 lies along the periphery of the housing of device 10 and display 12 and is therefore sometimes referred to as a peripheral gap. Gap 18 divides bezel 16 (i.e., there is generally no conductive portion of bezel 16 in gap 18). Gap 18 therefore interrupts bezel 16 as bezel 16 runs around the periphery of device 10. Because gap 18 is interposed within bezel 16 in this way, the electrical continuity of bezel 16 is broken (i.e., there is an open circuit in bezel 16 across gap 18).

As shown in FIG. 1, gap 18 may be filled with dielectric. For example, gap 18 may be filled with air. To help provide device 10 with a smooth uninterrupted appearance and to ensure that bezel 16 is aesthetically appealing, gap 18 may be filled with a solid (non-air) dielectric such as plastic. Bezel 16 and gaps such as gap (and its associated plastic filler structure) may form part of one or more antennas in device 10. For example, portions of bezel 16 and gaps such as gap 18 may, in conjunction with internal conductive structures, form one or more inverted-F antennas. The internal conductive structures may include printed circuit board structures, frame members or other support structures, conductive traces formed on the surface of plastic supports, fasteners such as screws, springs, strips of metal, wires, and other suitable conductive structures.

In a typical scenario, device 10 may have upper and lower antennas (as an example). An upper antenna may, for example, be formed at the upper end of device 10 in region 22. A lower antenna may, for example, be formed at the lower end of device 10 in region 20.

The upper antenna may, for example, be formed partly from the portions of bezel 16 in the vicinity of gap 18. The lower antenna may likewise be formed from portions of bezel 16 and a corresponding bezel gap.

Antennas in device 10 may be used to support any communications bands of interest. For example, device 10 may include antenna structures for supporting local area network communications, voice and data cellular telephone communications, global positioning system (GPS) communications, Bluetooth® communications, etc. As an example, the lower antenna in region 20 of device 10 may be used in handling voice and data communications in one or more cellular telephone bands, whereas the upper antenna in region 22 of device 10 may provide coverage in a first band for handling Global Positioning System (GPS) signals at 1575 MHz and a second band for handling Bluetooth® and IEEE 802.11 (wireless local area network) signals at 2.4 GHz (as examples). The lower antenna (in this example) may be implemented using a loop antenna design and the upper antenna may be implemented using an inverted-F antenna design.

Figure 2:
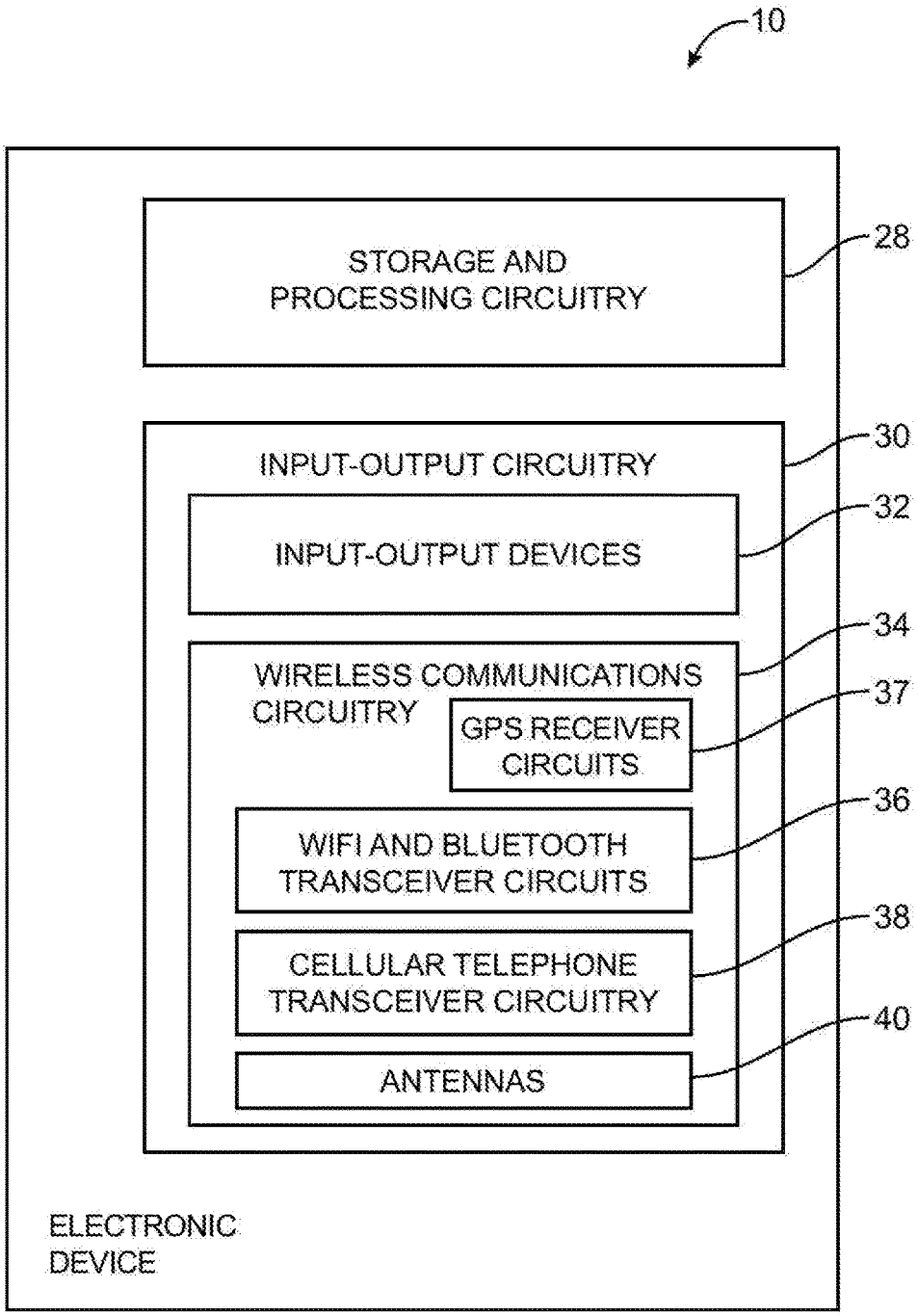
FIG. 2 is a schematic diagram of an illustrative electronic device with wireless communications circuitry in accordance with an embodiment of the present invention.

A schematic diagram of an illustrative electronic device is shown in FIG. 2. Device 10 of FIG. 2 may be a portable computer such as a portable tablet computer, a mobile telephone, a mobile telephone with media player capabilities, a handheld computer, a remote control, a game player, a global positioning system (GPS) device, a combination of such devices, or any other suitable electronic device.

As shown in FIG. 2, device 10 may include storage and processing circuitry 28. Storage and processing circuitry 28 may include storage such as hard disk drive storage, non-volatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, applications specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output devices 32 such as touch screens and other user input interface are examples of input-output circuitry 32. Input-output devices 32 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices such as display 14 (FIG. 1) and other components that present visual information and status data may be included in devices 32. Display and audio components in input-output devices 32 may also include audio equipment such as speakers and other devices for creating sound. If desired, input-output devices 32 may contain audio-video interface equipment such as jacks and other connectors for external headphones and monitors.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 34 may include radio-frequency transceiver circuits for handling multiple radio-frequency communications bands. For example, circuitry 34 may include transceiver circuitry 36 and 38. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as the GSM bands at 850 MHz, 900 MHz, 1800 MHz, and 1900 MHz, and the 2100 MHz data band (as examples). Wireless communications circuitry 34 can include circuitry for other short-range and long-range wireless links if desired. For example, wireless communications circuitry 34 may include global positioning system (GPS) receiver equipment such as GPS receiver circuitry 37 for receiving GPS signals at 1575 MHz or for handling other satellite positioning data, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structure, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

With one suitable arrangement, which is sometimes described herein as an example, the upper antenna in device 10 (i.e., an antenna 40 located in region 22 of device 10 of FIG. 1) may be formed using an inverted-F antenna design in which some of the antenna includes conductive device structures such as portions of bezel 16. Gap 18 may help define the shape and size of the portion of bezel 16 that operates as part of the antenna.

Figure 3:
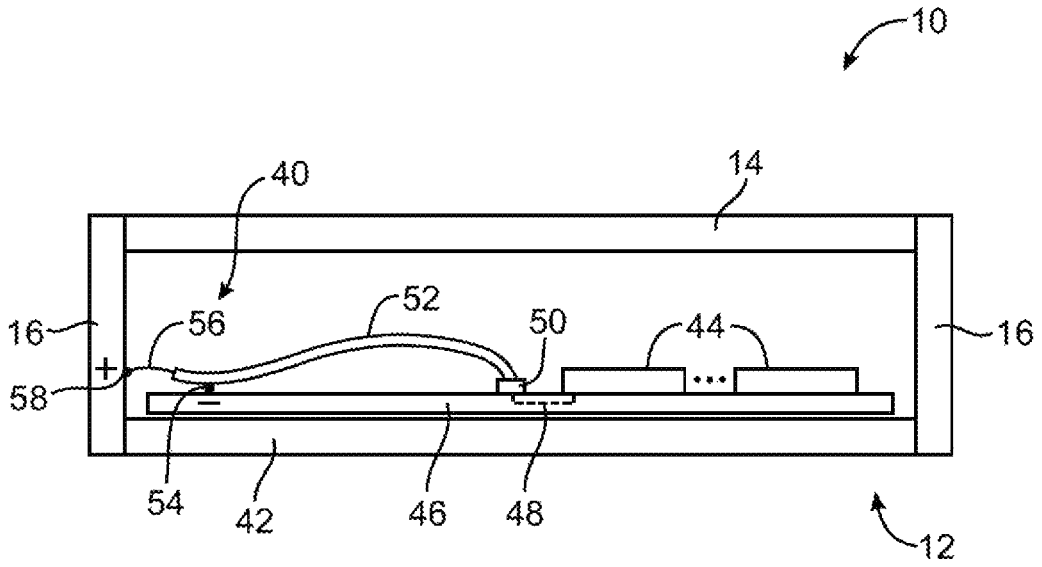
FIG. 3 is a cross-sectional view of an illustrative electronic device with wireless communications circuitry in accordance with an embodiment of the present invention.

A cross-sectional side view of an illustrative device 10 is shown in FIG. 3. As shown in FIG. 3, display 14 may be mounted to the front surface of device 10 using bezel 16. Housing 12 may include sidewalls formed from bezel 16 and one or more rear walls formed from structures such as planar rear housing structure 42. Structure 42 may be formed from a dielectric such as glass, ceramic, composites, plastic or other suitable materials. Snaps, clips, screws, adhesive, and other structures may be used in mounting display 14, bezel 16, and rear housing wall structure 42 within device 10.

Device 10 may contain printed circuit boards such as printed circuit board 46. Printed circuit board 46 and the other printed circuit boards in device 10 may be formed from rigid printed circuit board material (e.g., fiberglass-filled epoxy) or flexible sheets of material such as polymers. Flexible printed circuit boards ("flex circuits") may, for example, be formed from flexible sheets of polyimide.

Printed circuit board 46 may contain interconnects such as interconnects 48. Interconnects 48 may be formed from conductive traces (e.g., traces of gold-plated copper or other metals). Connectors such as connector 50 may be connected to interconnects 48 using solder or conductive adhesive (as examples). Integrated circuits, discrete components such as resistors, capacitors, and inductors, and other electronic components may be mounted to printed circuit board 46.

Antenna 40 may have antenna feed terminals. For example, antenna 40 may have a positive antenna feed terminal such as positive antenna feed terminal 58 and a ground antenna feed terminal such as ground antenna feed terminal 54. In the illustrative arrangement of FIG. 3, a transmission line path such as coaxial cable 52 may be coupled between the antenna feed formed from terminals 58 and 54 and transceiver circuitry in components 44 via connector 50 and interconnects 48. This is merely illustrative. Radio-frequency antenna signals may be conveyed between antenna 40 and transceiver circuits on device 10 using any suitable arrangement (e.g., transmission lines formed from traces on a printed circuit board, etc.).

Components 44 may include one or more integrated circuits for implementing transceiver (receiver) circuitry 37 and transceiver circuits 36 and 38 of FIG. 2. Connector 50 may be, for example, a coaxial cable connector that is connected to printed circuit board 46. Cable 52 may be a coaxial cable or other transmission line. Terminal 58 may be coupled to a positive conductor in transmission line 52 (e.g., a coaxial cable center connector 56). Terminal 54 may be connected to a ground conductor in transmission line (e.g., a conductive outer braid conductor in a coaxial cable). Other arrangements may be used for coupling transceivers in device 10 to antenna 40 if desired (e.g., using transmission lines formed on printed circuits). The arrangement of FIG. 3 is merely illustrative.

Figure 4:
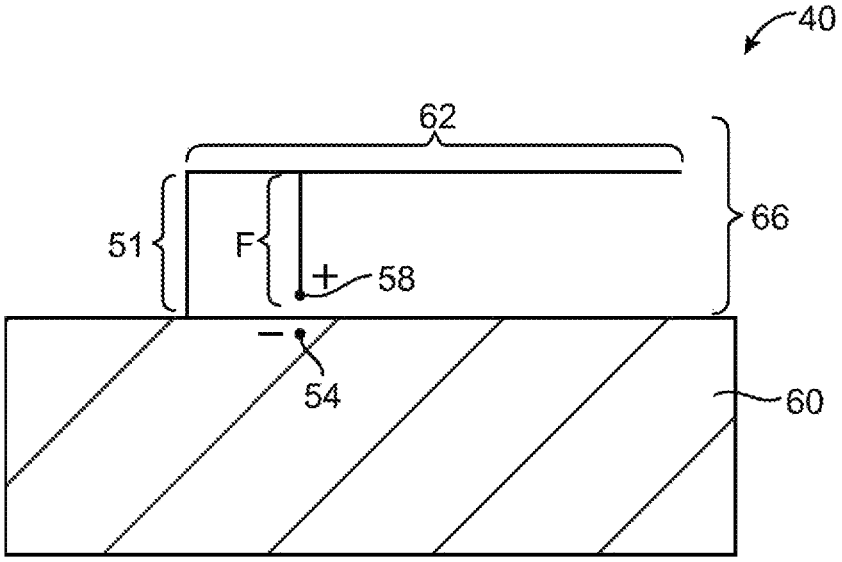
FIG. 4 is a diagram of an illustrative inverted-F antenna in accordance with an embodiment of the present invention.

Antenna 40 (i.e., the upper antenna of device 10 that is located in region 22 of FIG. 1) may be formed using an inverted-F design. An illustrative inverted-F antenna arrangement is shown in FIG. 4. As shown in FIG. 4, inverted-F antenna 40 may include a ground such as ground 60 and an antenna resonating element such as antenna resonating element 66.

Ground 60, which may sometimes be referred to as a ground plane or ground plane element, may be formed from one or more conductive structures (e.g., planar conductive traces on printed circuit board 46, internal structural members in device 10, electrical components 44 on board 46, radio-frequency shielding cans mounted on board 46, housing structures such as portions of bezel 16, etc.).

Antenna resonating element 66 may be have a main resonating element arm such as arm 62, a feed leg such as leg F, and a short circuit leg such as leg S1. Legs S1 and F may sometimes referred to as arms or branches of resonating element 66. Short circuit leg S1 may form a short circuit between antenna resonating element main arm 62 and ground 60. Antenna 40 may be fed by coupling a radio-frequency transceiver circuit between positive antenna feed terminal 58 on antenna feed leg F and ground antenna feed terminal 54.

Figure 5:
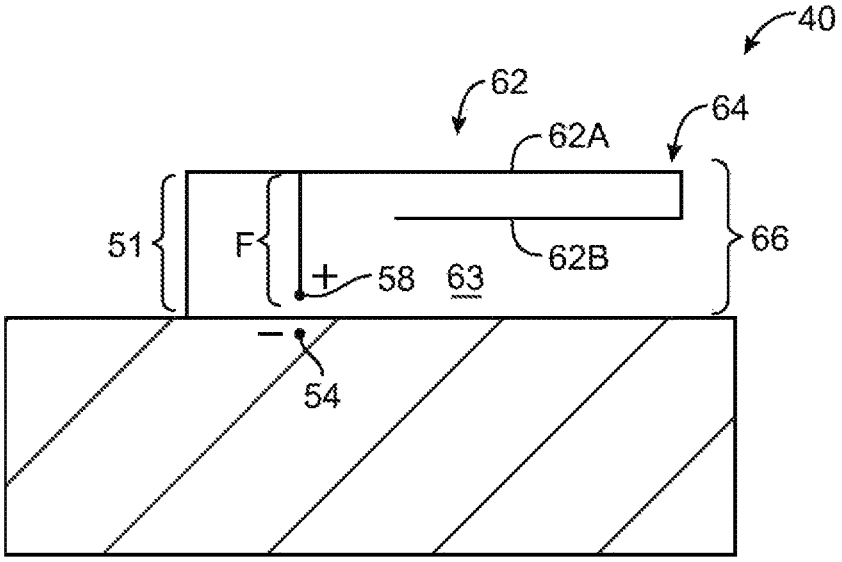
FIG. 5 is a schematic diagram of an illustrative folded inverted-F antenna in accordance with an embodiment of the present invention.

In some device environments, an inverted-F antenna of the type shown in FIG. 4 may consume more space than is desired. As shown in FIG. 5, space consumption may be minimized by providing antenna 40 with an antenna resonating element that has one or more bends. As shown in FIG. 5, antenna 40 may include a ground such as ground 60 and an antenna resonating element such as antenna resonating element 66 that is separated from ground 60 by dielectric-filled opening 63. Short circuit leg S1 may connect arm 62 to ground 60. Feed leg F may connect arm 62 to antenna feed terminal 58. Main resonating element arm 62 may have a bend such as bend 64.

Bend 64 may have any suitable angle (e.g., a right angle, an acute angle, an oblique angle, etc.). In the example of FIG. 5, bend 64 has a 180° angle (i.e., bend 64 makes a fold in arm 62). Due to the presence of bend 64, arm 62 has two parallel segments 62A and 62B.

Arm portion 62A and arm portion 62B run parallel to each other in the example of FIG. 5, but this is merely illustrative. Antenna resonating element arm 62 may, in general, be provided with bends of different angles and with different numbers of bends. Accordingly, there may be two or more resonating element arm segments in arm 62 and one, two, or more than two corresponding bends in arm 62. Arm 62 may also be provided with one or more separate branches, regions of locally increased or decreased width, or other features. These features may be used to improve the geometry of antenna 40 to accommodate design goals, to modify the frequency response of antenna 40, etc.

It may be desirable for antenna 40 to exhibit satisfactory performance over multiple frequency bands. For example, it may be desirable for antenna 40 to handle a first communications band at 1575 MHz (e.g., for handling GPS signals) at a second communications band at 2.4 GHz (e.g., for handling Bluetooth® and IEEE 802.11 signals). An illustrative antenna configuration that may be used in device 10 to support multiband operation is shown in FIG. 6.

Figure 6:
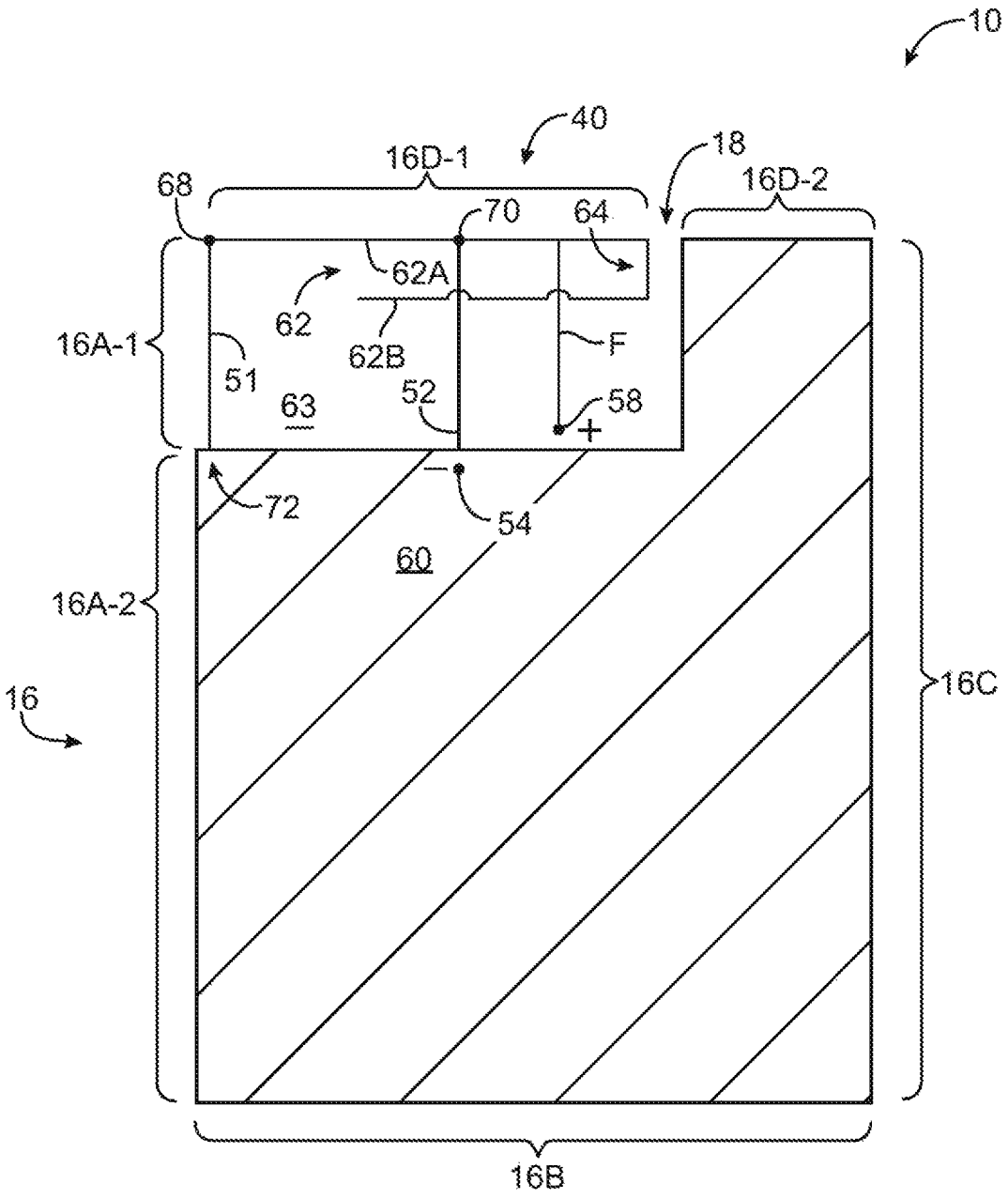
FIG. 6 is a top view of an electronic device showing how the electronic device may be provided with a folded inverted-F antenna having a shorting leg in accordance with an embodiment of the present invention.

As shown in FIG. 6, antenna 40 may have an inverted-F configuration in which resonating element arm 62 is folded back on itself at bend 64. Because of the presence of bend 64, arm segments 62A and 62B run parallel to each other. Feed leg F may connect resonating element arm 62 to positive antenna feed terminal 58. Antenna 40 may be fed using positive antenna feed terminal 58 and ground antenna feed terminal 54. For example, a positive conductor in transmission line 52 may be coupled to positive antenna feed terminal 58 and a ground conductor in transmission line 52 may be coupled to ground antenna feed terminal 54 (and thereby to the conductive portions of ground 60 that are connected to ground antenna feed terminal 54).

Housing structures 16 may be used in forming some of antenna 40. As shown in FIG. 6, housing structures 16 may include bezel segments 16A-1 and 16A-2 along the left edge of device 10, bezel segment 16C along the right edge of device 10, bezel segment 16B along the lower edge of device 10, and bezel segments 16D-1 and 16D-2 along the upper edge of device 10.

Short circuit leg S1 may be formed using bezel segment 16A-1. Segments 16A-1 and 16A-2 may be electrically connected at node 72 (i.e., segments 16A-1 and 16A-2 may be parts of an uninterrupted length of bezel 16. Bezel segment 16D-1 may be used in forming main resonating element arm segment 62A. Segment 62B may be formed from a conductive metal trace formed on a dielectric member in the interior of housing 12 (as an example). Springs, welds, and other conductive members may be interposed at one or more locations along the length of arm 62 if desired. Gap 18 may separate bezel segment 16D-1 and bezel segment 16D-2. The location of gap 18 may therefore define the length of 16D-1 and resonating arm segment 62A. The length of resonating element arm segment 62B may be defined by the size and shape of the conductive trace or other conductive structures that form segment 62B. If desired, some or all of bezel segments 16A-2, 16D-2, 16C, and 16B may shorted to ground plane 60. Some of all of these segments may also be used in forming additional antennas (e.g., a lower antenna for device 10). Ground plane 60 may be formed from traces on a printed circuit board, from conductive structures such as the structures associated with input-output port connectors, shielding cans, integrated circuits, traces on printed circuit boards, housing frame members, and other conductive materials.

Figure 7:
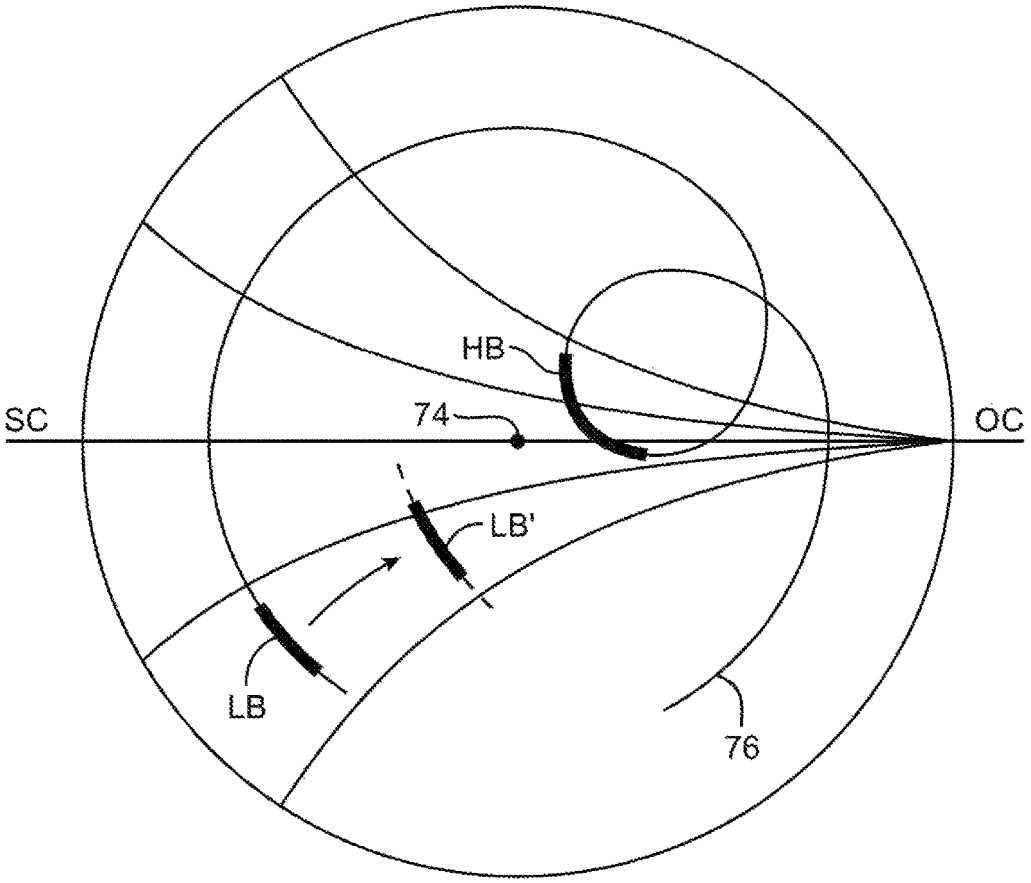
FIG. 7 is a Smith chart illustrating the performance of an antenna of the type shown in FIG. 6 in accordance with an embodiment of the present invention.

The presence of short circuit leg S2 in parallel with short circuit leg S1 may help antenna 40 handle signals in multiple bands. The impact of short circuit leg S2 may be understood with reference to the Smith chart of FIG. 7, which corresponds to antenna 40 in configurations with and without leg S2. In the Smith chart of FIG. 7, point 74 represents a 50 Ohm impedance (i.e., an impedance that is suitable for matching to a transmission line such as transmission line 52 of FIG. 3). At frequencies in which there are substantial deviations from point 74, antenna performance may be reduced due to impedance mismatches. At frequencies of antenna operation in which the distance to point 74 is minimized, impedance matching is generally satisfactory (i.e., the antenna will exhibit a resonance).

Curve 76 corresponds to the performance of antenna 40 in the absence of short circuit leg S2. Low band segment LB of curve 76 lies in a first communications band of interest (e.g., the 1575 MHz GPS band). High band segment HB lies in a second communications band of interest (e.g., the 2.4 GHz band that is associated with Bluetooth® and WiFi® signals).

In the absence of short circuit leg S2, low band segment LB may lie at a distance from point 74 that is larger than desired, while high band segment HB may be within an acceptably short distance from point 74. To tune the impedance of antenna 40 so that both low band and high band performance are simultaneously satisfactory, short circuit leg S2 may be included in antenna 40. In the presence of short circuit leg S2 there is an additional shunt inductance from arm 62 to ground 60 that lies in parallel with short circuit leg S1. This additional shunt inductance moves the position of low band segment LB to the location occupied by low band segment LB' in the chart of FIG. 7. Segment LB' is acceptably close to point 74, so antenna 40 will exhibit satisfactory low band (GPS) performance when short circuit leg S2 is present. Inclusion of short circuit leg S2 will tend to alter the position of high band segment HB somewhat, but any impact on high band performance in antenna 40 is generally minimal in comparison to the improved low band performance associated with segment LB'.

Figure 8:
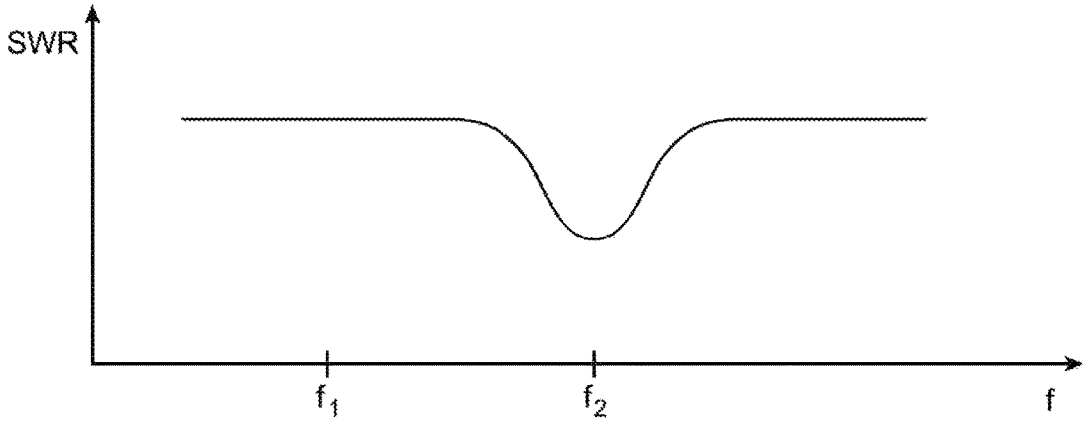
FIG. 8 is a graph showing the performance of an antenna of the type shown in FIG. 6 in the absence of the shorting leg in accordance with an embodiment of the present invention.
Figure 9:
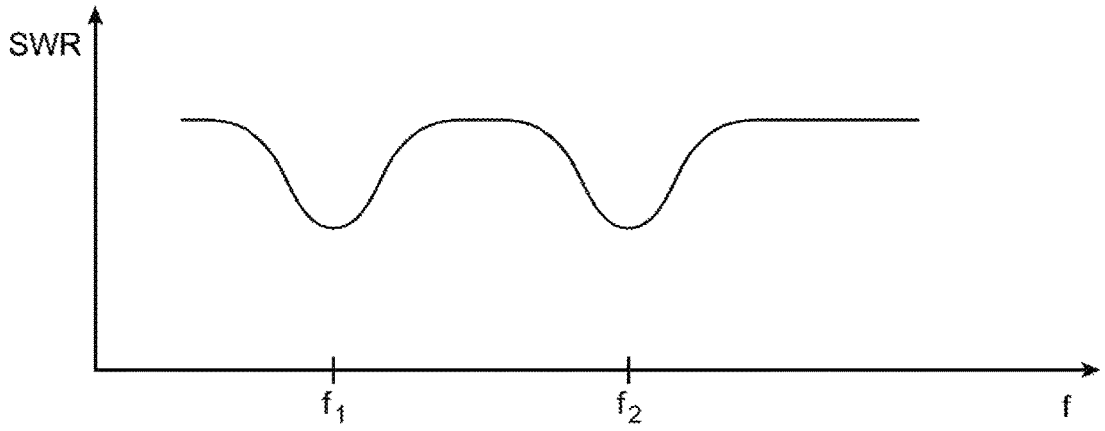
FIG. 9 is a graph showing the performance of an antenna of the type shown in FIG. 6 in the presence of the shorting leg in accordance with an embodiment of the present invention.

Graphs showing how antenna 40 may perform both with and without short circuit leg S2 are presented in FIGS. 8 and 9. In the graph of FIG. 8, standing wave ratio (SWR) values are plotted as a function of frequency for an antenna without short circuit leg S2 (i.e., antenna 40 of FIG. 5). In the graph of FIG. 9, standing wave ratio values are plotted as a function of frequency for an antenna in which short circuit leg S2 is present (i.e., antenna 40 of FIG. 6).

As shown in the graph of FIG. 8, an antenna without short circuit leg S2 may exhibit a resonance in a second wireless communications band (i.e., a second band at frequency $f_2$ such as a Bluetooth®/WiFi® band at 2.4 GHz), but may exhibit no significant resonance in a first frequency band (i.e., a first band at a frequency $f_1$ such as a GPS frequency of 1575 Mz). Antennas of this type may be used to handle wireless communications in the second frequency band.

As shown in the graph of FIG. 9, an antenna with short circuit leg S2 such as antenna 40 of FIG. 6 may exhibit resonances in both a first band (i.e., a first band at a frequency $f_1$ such as a GPS frequency of 1575 Mz) and a second band (i.e., a second band at frequency $f_2$ such as a Bluetooth®/WiFi® band at 2.4 GHz). Because an antenna with a frequency response of the type shown in FIG. 9 can handle radio-frequency signals in two bands, an antenna of this type is sometimes referred to as a multiband antenna or a dual band antenna. The use of an antenna that covers more than one band may avoid the need to provide multiple separate antenna structures, thereby minimizing the amount of space consumed within electronic device 10. If desired, antenna 40 may be configured to handle more than two bands (e.g., three or more). The dual band example of FIG. 9 is merely illustrative.

Figure 10:
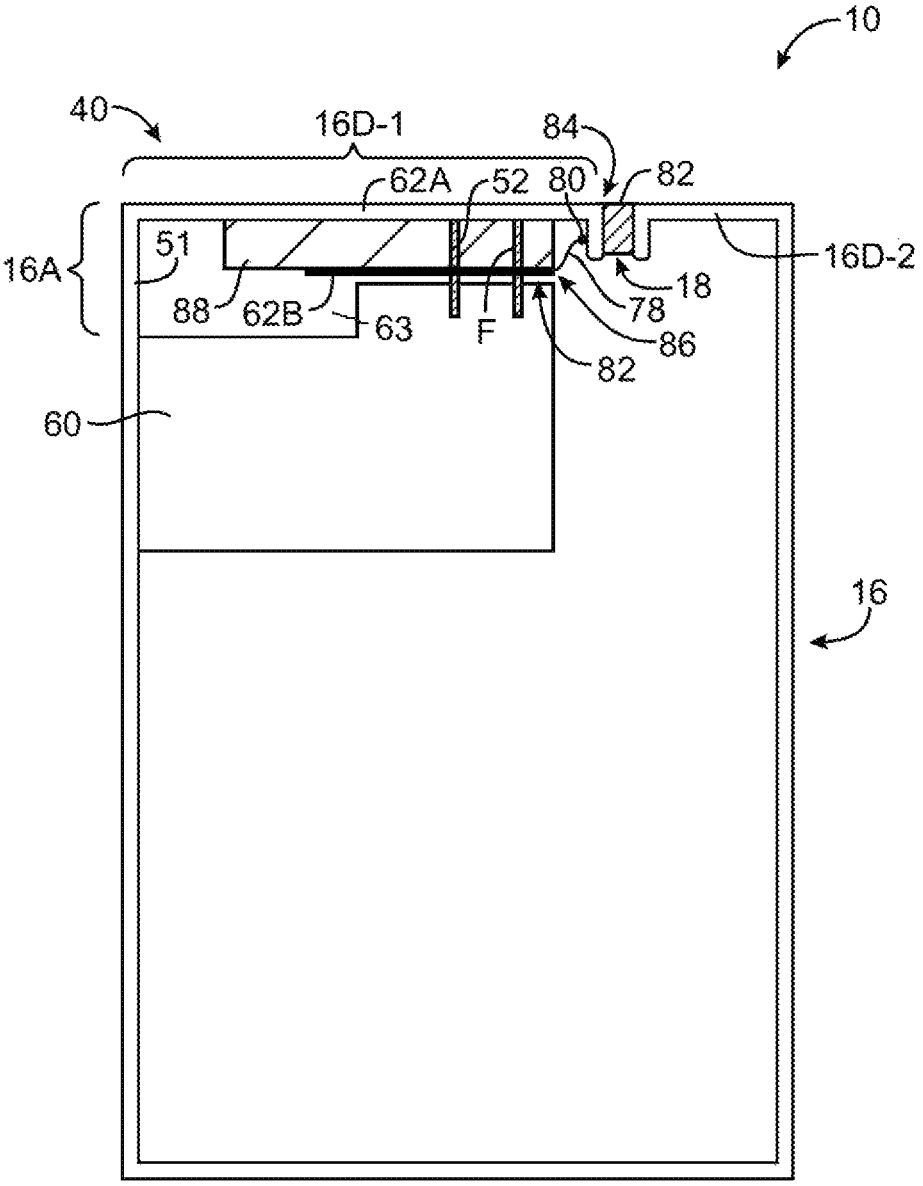
FIG. 10 is a top view of an illustrative electronic device that includes an antenna of the type shown in FIG. 6 that has been formed using part of a conductive bezel that surrounds the periphery of the electronic device in accordance with an embodiment of the present invention.

An illustrative arrangement that may be used in implementing antenna 40 of FIG. 6 is shown in FIG. 10. As shown in FIG. 10, antenna 40 of FIG. 10 may include a main antenna resonating element arm formed from resonating element arm segments 62A and 62B. Arm 62A may be formed from bezel segment 16D-1. Arm 62B may be formed from a conductive trace on dielectric member 88. Member 88 may be formed from plastic, glass, ceramic, composites, other materials, or combinations of these materials. One or more structures may be combined to form member 88. The conductive material that forms arm segment 62B on member 88 may be formed from a metal such as copper, copper plated with gold, etc. The metal may be formed directly on member 88 or may be fabricated as part of a flex circuit or other part that is attached to member 88 (e.g., using adhesive).

A conductive structure such as spring 78 may be used to electrically connect end 82 of the conductive trace on member 88 to end 84 of bezel segment 16D-1. Spring 78 may be formed from metal and may be attached to end 84 of bezel segment 16D-1 using weld 80. End 86 of spring 78 (i.e., the opposite end of spring 78 from the end at weld 80) may press against the conductive trace on member 88 to form an electrical connection. If desired, other connection arrangements may be used (e.g., involving solder, additional welds, fasteners, etc.).

In the FIG. 10 arrangement, short circuit leg S2 and feed leg F pass over or under resonating element arm segment 62B without forming a direct electrical connection with resonating element arm segment 62B (as shown schematically in FIG. 6). Legs S2 and F may be formed using screws, springs, or other suitable conductive structures. Short circuit leg S1 may be formed from part of bezel 16 (i.e., bezel segment 16A). Ground 60 may be formed using printed circuit board structures, parts of bezel 16, other parts of the housing of device 10, or other suitable conductive structures, as described in connection with FIG. 6.

Gap 18 may be filled with dielectric material 82 such as plastic, ceramic, epoxy, composites, glass, other dielectrics, or combinations of these materials.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device having four edges, a length, and a width, comprising:

conductive housing side walls that each extend along a respective one of the four edges of the electronic device;

an inverted-F antenna having an antenna resonating element that is formed from a segment of the conductive housing side walls that is adjacent to a dielectric-filled gap in the conductive housing side walls and having a short circuit leg that is separate from the conductive housing side walls;

a ground plane for the inverted-F antenna that extends across the width of the electronic device and that is surrounded by the conductive housing side walls, wherein a dielectric-filled opening is formed between the ground plane and the segment of the conductive housing side walls, the segment of the conductive housing side walls includes first and second substantially perpendicular portions that define edges of the dielectric-filled opening, and the short circuit leg extends from the segment of the conductive housing side walls to the ground plane across the dielectric-filled opening;

a first antenna feed terminal for the inverted-F antenna coupled to the segment of the conductive housing side walls; and a second antenna feed terminal for the inverted-F antenna coupled to the ground plane.

2. The electronic device defined in claim 1, wherein the electronic device has a height that is less than the length and the width and each of the conductive housing side walls extend across the height of the electronic device.

3. The electronic device defined in claim 1, further comprising:

a transmission line having a signal conductor;

a feed leg of the inverted-F antenna having a first end that is connected to the segment of the conductive housing side walls and a second end coupled to the signal conductor at the first antenna feed terminal, wherein the feed leg and the signal conductor extend across the dielectric-filled opening.

4. The electronic device defined in claim 1, wherein the electronic device has a height and front and rear surfaces and the conductive housing side walls extend across the height from the front surface to the rear surface of the electronic device.

5. The electronic device defined in claim 4, wherein the height is less than the width.

6. The electronic device defined in claim 5, wherein the width is less than the length.

7. The electronic device defined in claim 1, further comprising an additional short circuit leg coupled between the segment of the conductive housing side walls and the ground plane.

8. The electronic device defined in claim 7, wherein the additional short circuit leg is formed at least partly from an additional segment of the conductive housing side walls.

9. The electronic device defined in claim 8, wherein the segment of the conductive housing side walls and the additional segment of the conductive housing side walls extend respectively along first and second perpendicular exterior surfaces of the electronic device.

10. The electronic device defined in claim 1, further comprising a display, wherein the conductive housing side walls surround the display.

11. The electronic device defined in claim 1, further comprising a dielectric substrate attached to the segment of the conductive housing side walls.

12. The electronic device defined in claim 11, further comprising a conductive trace on the dielectric substrate that is electrically connected to the segment of the conductive housing side walls.

13. The electronic device defined in claim 11, further comprising a flexible printed circuit attached to the dielectric substrate, wherein the flexible printed circuit comprises a conductive trace that is electrically connected to the segment of the conductive housing side walls.

14. The electronic device defined in claim 13, wherein the flexible printed circuit is attached to the dielectric substrate by adhesive.

15. The electronic device defined in claim 12, further comprising a conductive spring, wherein the conductive trace is electrically connected to the segment of the conductive housing side walls through the conductive spring.

* * * * *